United States Patent [19]

Shyr et al.

[11] Patent Number: 5,042,664

[45] Date of Patent: Aug. 27, 1991

[54] UTILITY BAG

[76] Inventors: Michael Shyr, 1600 S. Curtis Ave., Alhambra, Calif. 91803; Godfrey Shyr, P.O. Box 55-673, Taipei, Taiwan

[21] Appl. No.: 437,533

[22] Filed: Nov. 16, 1989

[51] Int. Cl.[5] ..... B65D 69/00

[52] U.S. Cl. ..... 206/579; 190/109; 190/110; 190/112

[58] Field of Search ..... 206/579; 190/9, 102, 190/103, 107, 109, 110, 112

[56] References Cited

U.S. PATENT DOCUMENTS

| | | | |
|---|---|---|---|
| 1,137,579 | 4/1915 | Cohn | 190/9 |
| 2,018,809 | 10/1935 | Rodgers | 190/103 |
| 2,517,757 | 8/1950 | Adlerstein | 190/9 |
| 3,963,102 | 6/1976 | Carp | 190/109 |
| 4,212,377 | 7/1980 | Weinreb | 190/109 |
| 4,752,008 | 6/1988 | Pratt | 206/579 |
| 4,773,515 | 9/1988 | Kotkins, Jr. | 190/103 |
| 4,805,748 | 2/1989 | Gerch | 190/109 |
| 4,805,749 | 2/1989 | Gerch | 190/103 |
| 4,817,802 | 4/1989 | Pratt | 190/110 |

*Primary Examiner*—David T. Fidei
*Attorney, Agent, or Firm*—Denton L. Anderson

[57] ABSTRACT

A soft-sided utility bag having a hinged door-like end opening is provided, wherein a plurality of shelves can be used to divide the bag enclosure into two or more compartments. The shelves are supported by flexible suspension structures which can be easily displaced out of the way when not in use. The shelves can be conveniently stored within the bag when the full, undivided volume of the bag is needed. In some embodiments of the invention, the bag is collapsible for easy storage and/or transport.

21 Claims, 2 Drawing Sheets

UTILITY BAG

BACKGROUND

The present invention relates generally to utility bags and specifically to soft-sided utility bags useful as locker bags and for airline carry-on bags.

Soft-sided utility bags have become increasingly popular for use as airline carry-on baggage and as sports locker bags. Such soft-sided bags have been found to be sufficiently sturdy, relatively attractive and very lightweight and easy to carry.

An especially popular bag is a generally rectangular utility bag such as disclosed in U.S. Pat. No. 4,752,008. In this type of utility bag, a hinged end enclosure opens in doorlike fashion to give access to the interior of the bag. In U.S. Pat. No. 4,752,008 a bag is disclosed which further comprises a shelf for dividing the bag enclosure into two compartments. The shelf is supported on flexible straps and can be displaced out of the way against the back of the bag when an uninterrupted single volume is desirable.

It would be desirable to have a bag such as those disclosed in U.S. Pat. No. 4,752,008 which has more than one displaceable shelf so that the bag could be divided into more than two compartments. This would be especially convenient for use as a sports locker bag where one compartment could be used for sports shoes, another compartment for a uniform or workout clothing and a third compartment for baseball caps, sweat bands, sunglasses, etc. Unfortunately, no such bag is known to exist. It would also be desirable for a bag such as those disclosed in U.S. Pat. No. 4,752,008 to be collapsible so that it could be folded down for convenient storage or transport. Unfortunately, no such bag is known to exist.

There is therefore a need for a soft-sided utility bag having a hinged door-like end whose interior volume can be divided into more than two compartments by horizontal shelves which are within the bag.

There is also a need for such a utility bag which is collapsible for convenient storage and/or transport.

SUMMARY

The invention satisfies these needs.

The invention is a utility bag having a generally rectangular cross-section comprising six generally rectangular walls: a pair of opposed vertical side walls, a pair of opposed vertical end walls, a top wall and a bottom wall. One of the end walls acts as a door to the interior of the bag enclosure. On the interior of the bag, there is disposed at least one flexible shelf support member comprising two flexible vertical straps, each attached at a top end to the interior surface of one of the vertical side walls so that the two vertical straps hang downwardly along the opposed vertical side walls. A lower transverse strap is attached at its opposite ends to the two vertical straps at or proximate to the lower end of each such vertical strap. An upper transverse strap is likewise attached at its opposite ends to the two vertical straps at locations midway between the upper end of each vertical strap and the location on each vertical strap where is attached the lower transfer strap. By this configuration, the flexible support member provides an upper and a lower flexible shelf support. One or two rigid shelves having widths approximately equal to the width of the utility bag can be supported by the flexible support member to divide the bag enclosure into multiple compartments. When shelves are not desired, the flexible shelf support members can be pushed out of the way so that the full vertical height of the bag enclosure can be used.

Where the flexible straps which comprise the flexible shelf support member are relatively wide, a single flexible shelf support member can be employed. In a typical embodiment, however, two opposed flexible shelf support members, each comprised of relatively narrow flexible straps, are disposed at opposite ends of the bag enclosure. Each flexible shelf support member is adapted to support one end of one or more rigid shelves.

In another embodiment, the bag enclosure is comprised of oppositely disposed, spaced-apart frame members surrounded by a flexible skin such as canvas. In this embodiment, the bag can be collapsed. When additional rigidity is desired, however, an additional shelf is reversibly attached to the oppositely disposed frame along the bottom wall.

(The concept of reversible attachment as used in this application means attachment in such a way that the elements so attached can be alternatively de-attached and re-attached with ease and speed, and generally without tools. Examples of devices commonly used for reversible attachment are snaps, hooks, buttons, zippers and hook-and-loop fasteners such as those sold under the Velcro ® trademark.)

DESCRIPTION OF THE DRAWINGS

These and other features, aspects and advantages of the present invention will become understood with reference to the following description, appended claims and accompanying drawings where:

DESCRIPTION OF THE INVENTION

Figure 1:
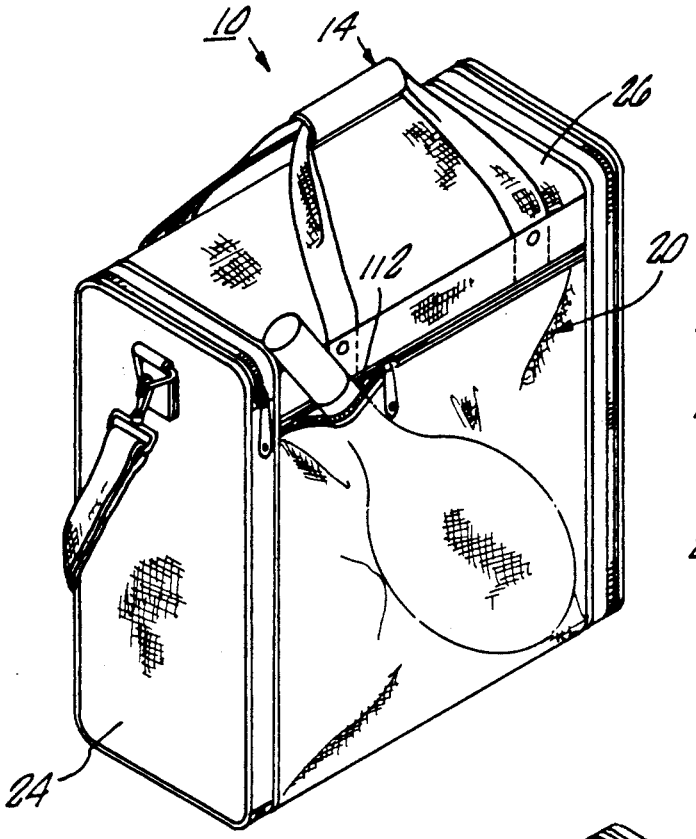
FIG. 1 is a perspective view of a utility bag having features of the invention.
Figure 2:
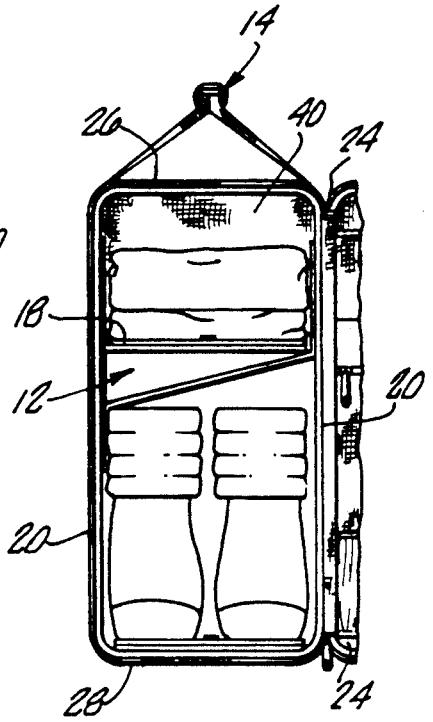
FIG. 2 is an end view of the utility bag of FIG. 1 illustrating how the forward end closure wall is pivoted away from the bag enclosure to expose the interior of the bag enclosure.

The invention is a utility bag 10 having a bag enclosure 12, a carrying handle 14 and at least one flexible shelf support member 16 for the internal support of one or more rigid shelves 18.

The bag enclosure 12 has a generally rectangular cross-section and is comprised of six walls, a pair of opposed vertical side walls 20, a pair of opposed end walls (rearward end closure member 22 and forward end closure member 24), a top wall 26 and a bottom wall 28.

Each of the walls has a generally rectangular shape. The walls can be rigid, but preferably, the walls are flexible so that the bag 10 can be made collapsible. Where flexible side walls 20 are employed, the walls are supported by a pair of opposed, generally rectangular, rigid frame members 30 having approximately equal dimensions. For example, each frame member 30 can be comprised of first and second parallel, spaced-apart elongate vertical frame elements 32 and 34 and upper and lower parallel spaced-apart elongate horizontal frame elements 36 and 38, attached end to end to form a rectangular frame structure defining a frame member opening 40 between the respective four frame elements. The frame elements can be of any suitable material, such as wood, metal, plastics or composites. In a typical embodiment, the frame members 30 are composed of metal wire.

As noted above, the side walls 20 can be rigid or flexible. When rigid walls 20 are desired, the walls 20 can be made of a light metal, a plastic or a composite material. Where flexible walls 20 are desirable, the walls 20 can be made of any thin flexible material, such as cloth, flexible plastic or rubber. A preferred material is a stiff canvas because of its relative rigidity, durability, light weight and ease with which it can be fastened together.

Alternatively, the side walls 20 can comprise an insulating material 42 such as a flexible plastic foam. Use of such an insulating material 42 minimizes the temperature variations within the interior of the bag enclosure 12. In one embodiment, the side walls 20 are comprised of a composite material with a canvas outer layer 44, an insulating polyurethane foam center layer 42 and a nylon inner lining layer 46.

The two end walls, the rearward end closure member 22 and the forward end closure member 24, are attached at opposite ends of the bag enclosure 12. The rearward end closure member 22 is generally rectangular and has a pair of parallel side edges 48 with approximately the same lengths as the vertical side walls 20 and an upper edge 50 and a lower edge 52 with approximately the same lengths as the transverse width of the top wall 26 and bottom wall 28. The rearward end closure member 22 is attached to the two vertical side walls 20 and to the top and bottom walls 26 and 28 along corresponding parallel contiguous edges so that the rearward end closure 22 effectively seals the rearward end of the bag enclosure 12.

The rearward end enclosure 22 can be made of any convenient lightweight material. Flexible materials and lightweight non-flexible materials can be used. In a typical embodiment, the rearward end enclosure 22 is manufactured from the same material as the side and top walls 20 and 26.

The external side of the rearward end enclosure 22 can include a variety of pockets (not shown) for conveniently storing small, miscellaneous items.

Figure 4:
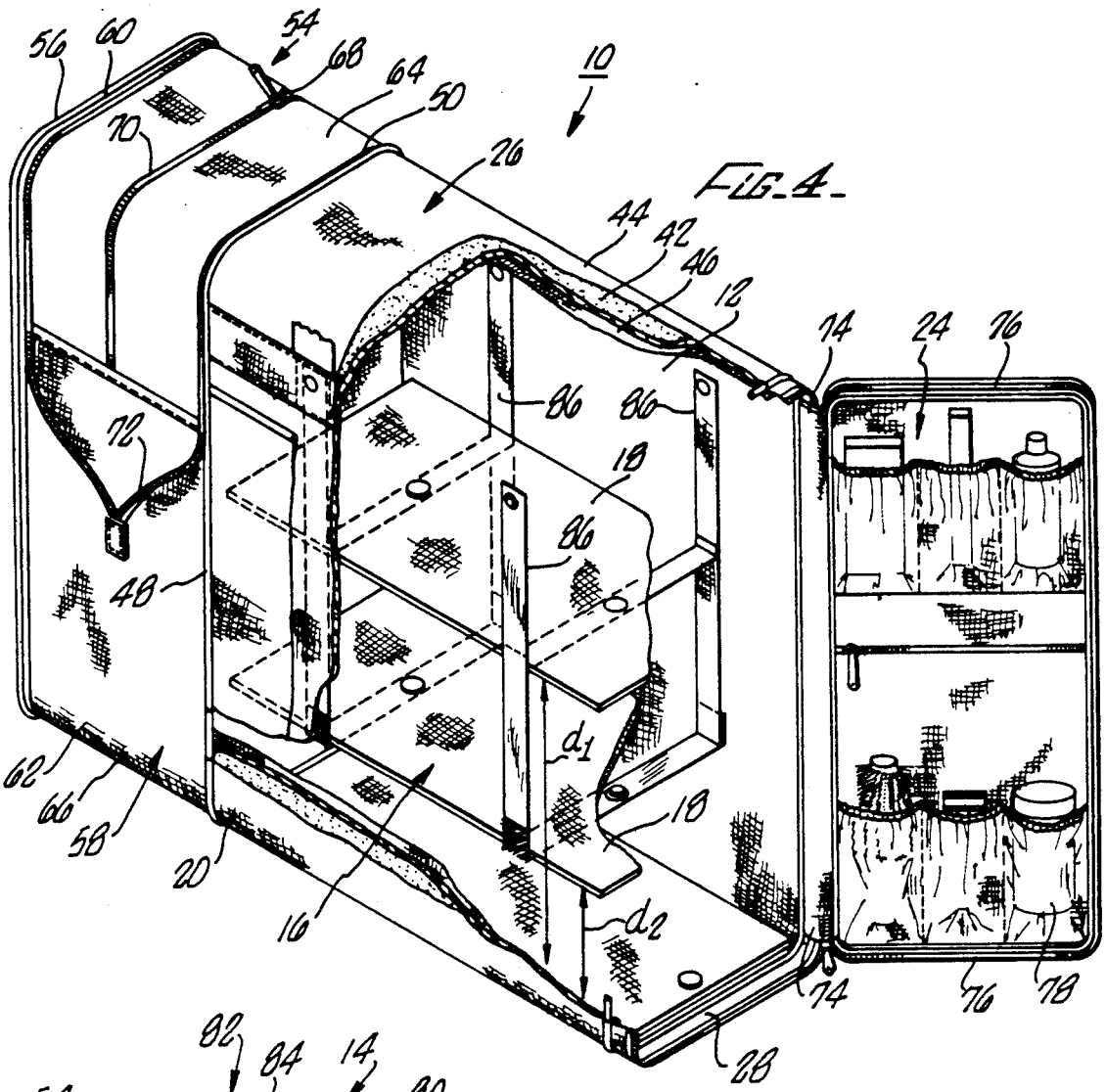
FIG. 4 is a perspective, partial cross-sectional view of a second utility bag having features of the invention.
Figure 5:
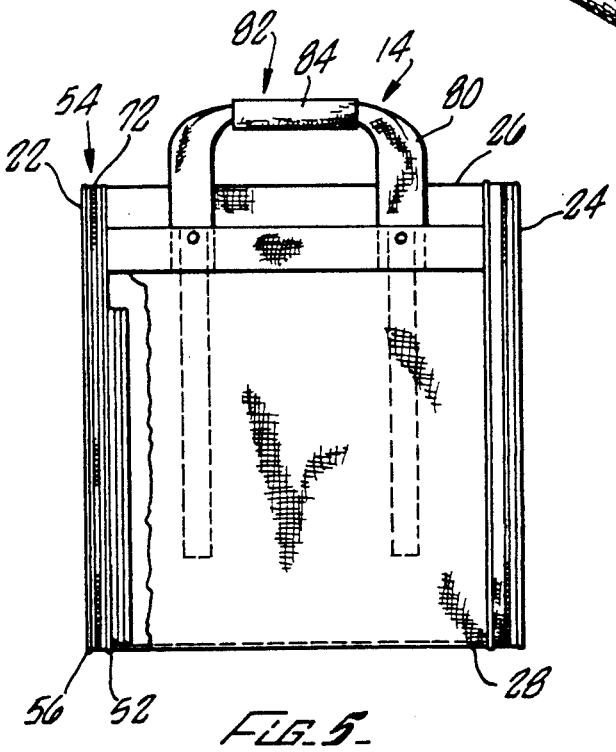
FIG. 5 is a side view of the utility bag of FIG. 4.
Figure 6:
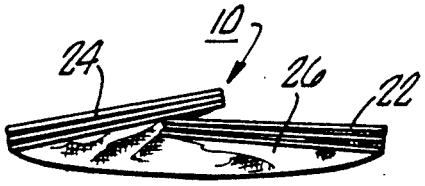
FIG. 6 is a top view of the utility bag of FIG. 5 illustrating how the utility bag can be folded to collapse.

In one embodiment, the rearward end closure member 22 is expandable to provide an alternative additional enclosure compartment 54. The expandability is provided by an expansion frame member 56 having equal dimensions to the rearward frame member 22, and a continuous, foldable expansion skin 58 attached about the circumference of the expansion frame member 56 along its rearward edge 60 and stretchable between the rearward frame member 22 and the expansion frame member 56. The expansion-produced additional enclosure compartment 54 can thereby be created with the expansion skin 58 forming opposing parallel expansion skin side walls 62, an expansion skin top wall 64 and an expansion skin bottom wall 66, the rearward closure element 22 forming a first end wall and the expansion frame member 56 forming the second end wall. Access to the additional enclosure compartment 54 can be achieved through an expansion compartment opening 68 which can be alternatively sealed and unsealed with a fastening device 70 such as a conventional zipper. The additional enclosure compartment 54 can be alternatively compressed and expanded by an external fastening device 72, such as a conventional zipper as shown in FIG. 4.

The forward end closure member 24 forms a doorway for access to the bag enclosure 12. Preferably the forward end closure member 24 is attached to one of the vertical side walls 20 with a hinge device 74 so that the forward end closure member 24 can be swung outwardly away from the bag enclosure 12. In this embodiment, the forward end closure member 24 can alternatively be closed against the vertical side walls 20, top wall 26 and bottom wall 28 to effectively seal the forward end of the bag enclosure 12. The sealing means 76 is a reversible attachment means, such as a conventional zipper circumscribing the non-hinged interface between the side walls 20 and top and bottom walls 26 and 28 and the forward end closure member 24.

The forward end closure member 24 can be made from any convenient lightweight continuous material, such as a plastic, lightweight metal or cloth. In a typical embodiment, the forward end closure member 24 is made from the same material as comprises the side walls 20 and the top wall 26.

A variety of pockets 78 may be disposed within both the external side and the internal side of the forward end closure member 24 for conveniently storing small miscellaneous items.

The carrying handle 14 of any convenient type and shape is attached to the exterior of the bag enclosure 12 to permit the bag 10 to be picked up and carried. In the embodiment illustrated in the drawings, the handle 14 comprises two flexible handle straps 80. The ends of each strap 80 are attached spaced-apart near the upper edge of one of the side walls 20. The two handle straps 80 are attached together to form a single handle grip 82 by a flexible clasp 84. The clasp 84 can be permanently attached to the two handle straps 80. In the alternative, the clasp 84 can be held together with a reversible fastener (not shown) such as a snap or a hook-and-loop fastener so that the clasp 84 can be easily removed from the handle straps 80 when desired.

In the embodiments illustrated in the drawings, two spaced-apart flexible shelf support members 16 are disposed within the interior of the bag enclosure 12. Each shelf support member 16 is comprised of two spaced-apart, opposing flexible vertical straps 86 and two spaced-apart, opposing flexible transverse straps: lower transverse strap 88 and upper transverse strap 89. Each flexible vertical strap 86 is attached near its upper end 90 to the interior surface of one of the side walls 20. Thus, the two vertical straps 86 are disposed opposite each other, each hanging vertically downward from an upper attachment point 92 along an interior surface of one of the side walls 20.

The lower transverse strap 88 is attached between the two vertical straps 86 near the lower ends 94 of the vertical straps 86. Each end of the lower transverse strap 88 is attached to one of the opposing vertical straps 86 at a distance $d_2$ above the bottom wall 28. The upper transverse strap 89 is likewise attached at opposite ends to each of the two vertical straps 86 but intermediate between the upper ends 90 of the vertical straps 86 and the locations where the lower transverse strap 88 is attached to the two vertical straps 86. Each end of the upper transverse strap 89 is attached to one of the opposing verticle straps 86 at a distance $d_1$ above the bottom wall 28. The distance $d_2$ is smaller than the distance $d_1$. By this configuration, the two transverse straps 88 and 89 form transverse, spaced-apart, horizontal supporting elements capable of accepting and supporting a rigid horizontal shelf 18 having a width less than or equal to the distance between the two side walls 20. Each verticle strap 86 is attached to the interior surface of the sidewall 20 at a distance below the top wall 26 which is less than the distance between the point at which the verticle strap 86 is attached to the sidewall 20 and the point at which the lower transverse 88 is attached to the verticle strap 86. This feature allows the shelf support member 16 to be displaced completely out of the way for convenient sue of the entire bag enclosure volume.

As illustrated in the drawings, two flexible shelf support members 16 can be disposed longitudinally on the interior of the bag enclosure 12 to form a rearward shelf support 96 and a forward shelf support 98. It should be understood, however, that a single shelf support member 16 comprised of straps with relatively large widths could be employed in the invention.

The straps in the flexible shelf support members 16 can be made out of any suitable flexible material. In a typical embodiment, the straps are made from a woven cotton or nylon.

Preferably, the lower ends 94 of each of the vertical straps 86 can be reversibly attached to the interior surface of the side wall 20 to which its upper end 90 is attached. Such reversible attachment of the lower vertical strap ends 94 permits the flexible shelf support members 16 to be made relatively rigid within the bag enclosure 12 with relatively taut transverse straps 88 and 89.

Figure 3:
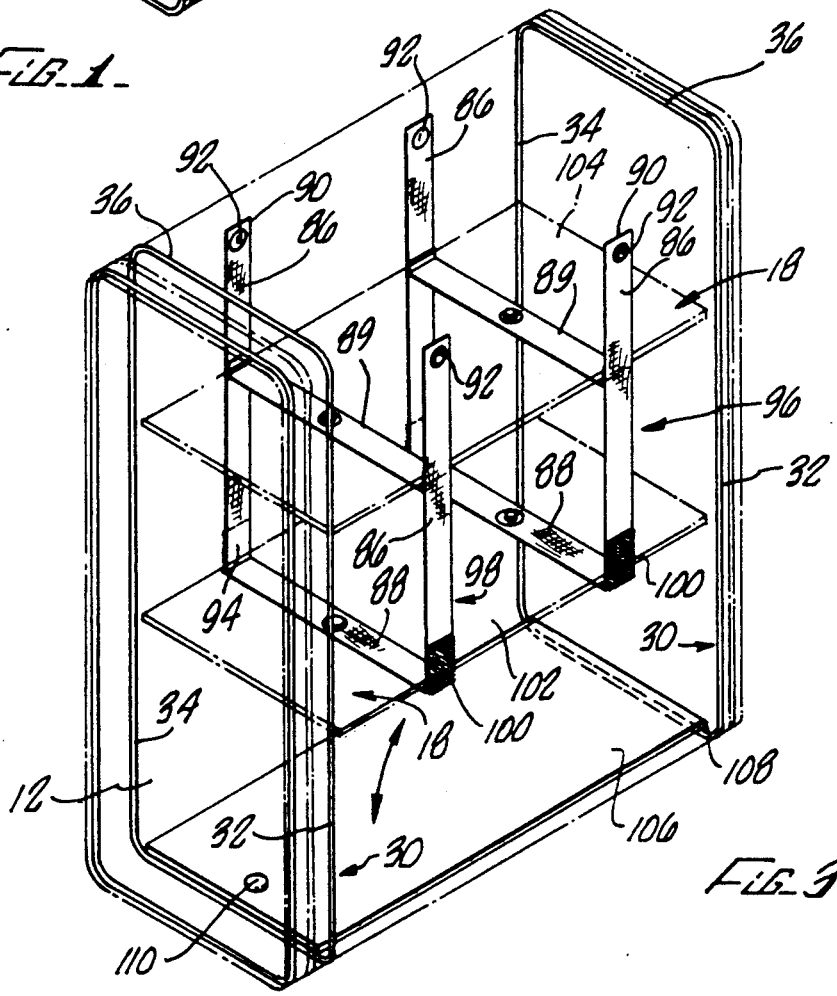
FIG. 3 is a perspective-cross-sectional view of the utility bag of FIG. 1 illustrating the configuration of two flexible shelf support members and three rigid shelves.

In the embodiments illustrated in FIGS. 3 and 4, the lower ends 94 of the vertical straps 86 are reversibly attached to the side walls 20 with a hook-and-loop fasteners 100. Snaps and other similar reversible attachment means can be used. In an alternative embodiment (not shown in the drawings) attachment means can be disposed along the interior side of the vertical walls 20 at several different elevations so that the height of the lower transverse strap 88 of each of the flexible shelf support members 16 is adjustable upwardly.

One or more shelves 18 can be disposed within the bag enclosure 12 supported upon the transverse straps 88 and 89 of the flexible shelf support members 16 to form a horizontal shelf. In the embodiments of the invention illustrated in the drawings, a lower shelf 102 is disposed upon and is supported by the lower transverse straps 88 and an upper shelf 104 is disposed upon and supported by the upper transverse straps 89.

Preferably, the shelves 18 are made of a lightweight, rigid material. Woods, lightweight metals, plastics and composite materials can be used.

Preferably, the shelves 18 have approximately the same widths as the distance between the side walls 20 of the bag enclosure 12, and approximately the same lengths as the distance between the two end closure members 22 and 24. With these dimensions, the shelves 18, when disposed upon the flexible shelf support members 16 within the bag enclosure 12, impart to the bag enclosure 12 a significant additional amount of rigidity.

It is important that the shelves 18 be easily removable from the shelf support members 16 for flexibility in the use of the bag 10. When not in use, the shelves 18 can be conveniently stored along the bottom wall 28 of the bag 10. In embodiments of the invention wherein the height of the bag 10 is greater than the length of the shelves 18. The shelves 18 can be also stored against the rearward end closure member 22. In such embodiments, the bag 10 remains collapsible, even with the shelves 18 are stored within the bag enclosure 12.

When neither of the two shelves 18 is in use or when only the upper shelf 104 is being used, the unused portion of the shelf support members 16 are easily displaced out of the way for full and convenient use of the remainder of the bag enclosure volume.

In the embodiments illustrated in the drawings, a third rigid bottom shelf 106 is disposed along the bottom wall 28 of the bag enclosure 12, permanently attached at the rearward frame member 30 by a hinge attachment 108 and reversibly attached to the forward frame member with a snap 110. When it is desirable to collapse the bag 10, the bottom shelf 106 is conveniently rotated upwardly along the hinge attachment 108 until it is contiguous with the rearward end enclosure member 22. Other reversible attachment means, such as hook-and-loop fasteners can, of course, be used. Also, the rearward end of the bottom shelf 106 need not be permanently affixed at the rearward frame member 30 but can also be reversibly attached. In any case, the attachment of this bottom shelf 106 at the opposed frame members 30 imparts a considerable degree of rigidity to the bag 10.

As illustrated in the drawings, the external surface of the bag enclosure 12 can also include a variety of pockets and compartments 112 for the storage of miscellaneous items.

As can be seen from the foregoing, the utility bag of the invention is very useful as a tote bag, gym bag, carry-on airline luggage, pullman bag, etc. It is light and easy to carry. It can be easily subdivided into several interior compartments by the insertion of one or detachable shelves. Many embodiments of the bag are fully collapsible for easy storage and/or for easy transport within other luggage.

Although the present invention has been described in considerable detail with reference to certain preferred versions, other versions are possible. Therefore, the spirit and scope of the appended claims should not necessarily be limited to the description of the preferred versions contained herein.

I claim:

1. A utility bag comprising:

(a) a bag enclosure, having an exterior and an interior, the bag enclosure comprising (i) first and second vertical side walls having interior surfaces and exterior surfaces, and being generally rectangular in shape and disposed spaced-apart parallel to one another, (ii) a top wall, (iii) a bottom wall, (iv) a rearward end wall, and (v) a forward end wall, wherein the forward end wall can be moved from a first forward end wall position wherein the interior of the bag enclosure is exposed and a second forward end wall position wherein the interior of the bag enclosure is not exposed;

(b) handle means attached to the bag enclosure for lifting the bag;

(c) a rearward flexible shelf support member disposed proximate to the rearward wall comprising (i) first and second vertical straps each having an upper end and a lower end, the upper ends of the first and second vertical straps being attached on the opposing interior surfaces of the vertical side walls and (ii) a first transverse strap having first and second ends, the first end being attached to the first vertical strap a distance $d_1$ above the bottom wall and the second end being attached to the second vertical strap a distance $d_1$ above the bottom wall; wherein each of the first and second vertical straps is attached to a vertical wall at an attachment point which is disposed at a distance below the top wall, such distance being less than the distance between the attachment point and the first transverse strap so that the rearward flexible shelf support member can be pushed out of the way to allow the use of the entire bag enclosure volume; and (d) a forward flexible shelf support member disposed proximate to the forward wall comprising (i) third and fourth vertical straps each having an upper end and a lower end, the upper ends of the third and fourth vertical straps being attached on the opposing interior surfaces of the vertical side walls and (ii) a second transverse strap having first and second ends, the first end being attached to the third vertical strap a distance $d_1$ above the bottom wall and the second end being attached to the fourth vertical strap a distance $d_1$ above the bottom wall; wherein each of the third and fourth vertical straps is attached to a vertical wall at an attachment point which is disposed at a distance below the top wall, such distance being less than the distance between the attachment point and the second transverse strap so that the forward flexible shelf support member can be pushed out of the way to allow the use of the entire bag enclosure volume;

whereby a planar first shelf having a forward end, a rearward end, a width approximately equal to the distance between the first and second vertical side walls, and a length approximately equal to the distance between the rearward end wall and the forward wall can be disposed within the bag enclosure parallel to and spaced apart from the bottom wall by supporting the rearward end of the first shelf on the first transverse strip of the rearward shelf support member and by supporting the forward end of the first shelf on the second transverse strap of the forward shelf support member.

2. The utility bag of claim 1 further comprising:

(a) a third transverse strap having first and second ends, the first end being attached to the first vertical strap a distance $d_2$ above the bottom wall and the second end being attached to the second vertical strap a distance $d_2$ above the bottom wall;

(b) a fourth transverse strap having first and second ends, the first and end being attached to the third vertical strap a distance $d_2$ above the bottom wall and the second end being attached to the fourth vertical strap a distance $d_2$ above the bottom wall;

wherein distance $d_2$ is less than $d_1$.

3. The utility bag of claim 1 wherein the bag enclosure is collapsible.

4. The utility bag of claim 1 further comprising at least one planar shelf having a forward end, a rearward end, a width approximately equal to the distance between the first and second vertical side walls, and a length approximately equal to the distance between the rearward end wall and the forward end wall, the shelf being disposed within the bag enclosure parallel to and spaced apart from the bottom wall by being supported at its rearward end by the rearward shelf support member and at its forward end by the forward shelf support member.

5. The utility bag of claim 2 further comprising two planar shelves, a lower shelf and an upper shelf, each shelf having a forward end, a rearward end, a width approximately equal to the distance between the first and second vertical side walls and a length approximately equal to the distance between the rearward end wall and the forward end wall, the upper shelf being disposed within the bag enclosure parallel to and spaced apart from the bottom wall by being supported at its rearward end by the first transverse strap and at its forward end by the second transverse strap, and the lower shelf being disposed within the bag enclosure parallel to and spaced apart from the bottom wall by being supported at its rearward end by the third transverse strap and at its forward end by the fourth transverse strap.

6. The utility bag of claim 1 further comprising a bottom shelf with a forward end and a rearward end and having a width approximately equal to the distance between the first and second vertical side walls and a length approximately equal to the distance between the rearward end wall and the forward end wall, the bottom shelf being disposed within the bag enclosure and supported by the bottom wall.

7. The utility bag of claim 6 wherein the forward end of the bottom shelf is affixed to the interior of the bag enclosure proximate to the forward end wall and wherein the rearward end of the bottom shelf is affixed to the interior of the bag enclosure proximate to the rearward end wall.

8. The utility bag of claim 7 wherein the bottom shelf is attached to the two frame members in a reversible manner.

9. The utility bag of claim 8 wherein the bottom shelf is attached to the interior of the bag enclosure with snaps.

10. The utility bag of claim 1 further comprising fastener means for reversibly attaching the planer shelf to at least one of the transverse straps.

11. The utility bag of claim 10 wherein the fastener means are snaps.

12. The utility bag of claim 1 further comprising strap attaching means for reversibly attaching a portion of at least one of the vertical straps proximate to its lower end to the interior surface of the vertical side wall.

13. The utility bag of claim 12 wherein the attachment means are hook and loop fasteners.

14. The utility bag of claim 12 wherein at least one of the vertical straps can be reversibly attached to the interior surface of the vertical wall at more than one elevation above the bottom wall.

15. A utility bag comprising:

(a) forward and rearward generally rectangular frame members having approximately equal dimensions and each consisting of first and second parallel spaced-apart elongate vertical frame elements and upper and lower parallel spaced-apart elongate horizontal frame elements, the forward and rearward frame members each defining a frame member opening between their respective four frame elements;

(b) an enclosure skin comprised of four generally rectangular flexible planar walls having interior and exterior surfaces: (i) a first side wall disposed non-tautly between the first vertical elements of the two frame members, (ii) a second side wall disposed non-tautly between the second vertical elements of the two frame members, (iii) a top wall disposed nontautly between the upper elements of the two frame members, and (iv) a bottom wall disposed non-tautly between the lower elements of the two frame members, the two side walls being attached to the top and bottom walls along parallel contiguous edges so that the four walls form an enclosure having an interior and an exterior and having a generally rectangular cross-section;

(c) a generally rectangular rearward end closure member having a pair of parallel side edges with approximately the same lengths as the vertical elements of the rearward frame member, and an upper edge and a lower edge with approximately the same lengths as the horizontal elements of the rearward frame member, the rearward end closure member being attached to the four walls of the enclosure proximate to the rearward frame member to form an enclosing rearward end wall;

(d) a forward end closure member having a pair of parallel side edges with approximately the same lengths as the vertical elements of the forward frame member, and an upper edge and a lower edge with approximately the same lengths as the horizontal elements of the forward frame member;

(e) means for attaching the forward end closure member to the four walls of the enclosure so as to form a closeable forward end wall which is alternatively movable from a first forward end closure position wherein the forward end closure member covers the forward frame member opening and a second forward end closure position wherein the forward end closure member does not cover the forward frame member opening;

(f) a handle attached to the outside of the bag enclosure for lifting the bag;

(g) at least one flexible shelf support member comprising (i) two flexible vertical straps having upper ends and lower ends, the upper ends being attached on the interior of opposing side walls proximate to the top wall and at equal heights above the lower wall, (ii) a lower transverse strap having first and second ends, the first end of the lower strap being attached proximate to the lower end of the first vertical strap and the second end of the lower strap being attached proximate to the lower end of the second vertical strap, and (iii) at least one upper transverse strap having first and second ends, the first end of the upper transverse strap being attached to the first vertical strap at a location intermediate between the upper end of the first vertical strap and the first end of the lower transverse strap and the second end of the upper transverse strap being attached to the second vertical strap intermediate between the upper end of the second vertical strap and the second end of the lower transverse strap;

(h) at least one shelf having a width approximately equal to the distance between the first and second vertical side walls, and a length approximately equal to the distance between the rearward end wall and the forward end wall, the shelf being disposed within the bag enclosure supported by one of the two transverse straps;

(i) fastener means for reversibly attaching a shelf to at least one of the transverse straps;

(j) strap attaching means for reversibly attaching a portion of each vertical strap proximate to its lower end to the interior surface of the vertical side wall; and (k) a bottom shelf with a forward end and a rearward end and having a width approximately equal to the distance between the first and second vertical side walls and a length approximately equal to the distance between the rearward end wall and the forward end wall, the bottom shelf being disposed within the bag enclosure and reversibly attached at its forward end to the forward frame member and at its rearward end to the rearward frame member.

16. The utility bag of claim 15 wherein the distance between the first and second vertical elements of each frame member is between about three inches and about 12 inches, the distance between the upper and lower horizontal frame elements is between about 6 inches and about 24 inches and the distance between the two frame members is between about 8 inches and about 36 inches.

17. The utility bag of claim 15 wherein the enclosure skin is comprised of canvas.

18. The utility bag of claim 15 wherein the enclosure skin is comprised of a foam insulation material.

19. The utility bag of claim 15 wherein the rearward end closure member is expandable.

20. The utility bag of claim 15 wherein the forward end closure member is attached to the bag enclosure with a hinge.

21. The utility bag of claim 15 wherein the means for attaching the forward end closure member comprises a zipper disposed along the side edges of the forward end closure members and the side edges of the four walls of the bag enclosure.

* * * * *